US012617497B2

(12) United States Patent
Grall

(10) Patent No.: US 12,617,497 B2
(45) Date of Patent: May 5, 2026

(54) SHIP COMPRISING A SYSTEM FOR ADAPTING A REMOVABLE MODULE AND ADAPTED REMOVABLE MODULE

(71) Applicant: IXBLUE, Saint-Germain-en-Laye (FR)

(72) Inventor: Sébastien Grall, Saint-Germain-en-Laye (FR)

(73) Assignee: EXAIL, Saint-Germain-en-Laye (FR)

( * ) Notice: Subject to any disclaimer, the term of this patent is extended or adjusted under 35 U.S.C. 154(b) by 712 days.

(21) Appl. No.: 17/802,456

(22) PCT Filed: Feb. 25, 2021

(86) PCT No.: PCT/EP2021/054686
§ 371 (c)(1),
(2) Date: Aug. 25, 2022

(87) PCT Pub. No.: WO2021/170721
PCT Pub. Date: Sep. 2, 2021

(65) Prior Publication Data

US 2023/0135453 A1 May 4, 2023

(30) Foreign Application Priority Data

Feb. 26, 2020 (FR) ..... 2001894

(51) Int. Cl.
*B63B 27/36* (2006.01)
*B63B 21/00* (2006.01)
(Continued)

(52) U.S. Cl.
CPC ..... *B63B 27/36* (2013.01); *B63B 21/00* (2013.01); *B63B 27/16* (2013.01); *B63B 35/00* (2013.01); *B63B 2027/165* (2013.01)

(58) Field of Classification Search
CPC ..... B63B 27/00; B63B 27/36; B63B 35/00; B63B 35/44; B63B 21/00; B63B 21/56; B63B 27/16; B63B 2027/165
(Continued)

(56) References Cited

U.S. PATENT DOCUMENTS 4,476,798 A * 10/1984 Backus ..... B63B 3/08 114/255
5,222,454 A 6/1993 Meyer
(Continued)

FOREIGN PATENT DOCUMENTS

| | | |
|---|---|---|
| FR | 3 080 601 | 11/2019 |
| WO | 2010/115977 | 10/2010 |
| WO | 2012/069853 | 5/2012 |

OTHER PUBLICATIONS

International Search Report dated Jun. 11, 2021, for PCT/EP2021/054686, 6 pp., including English translation.
(Continued)

*Primary Examiner* — Lars A Olson
(74) *Attorney, Agent, or Firm* — NIXON & VANDERHYE

(57) ABSTRACT

Disclosed is a base ship that can receive, in a removable and interchangeable manner, a particular module among various modules, the module being adapted to a functional specialization of the ship. The base ship is similar to a catamaran in its rear portion because it includes two parallel rear lateral volumes that are substantially symmetric with respect to a vertical longitudinal sagittal plane of the base ship, and the removable module is inserted and secured between the two rear lateral volumes of the base ship in order to form a functionalized ship.

12 Claims, 10 Drawing Sheets

(51) Int. Cl.
*B63B 27/16* (2006.01)
*B63B 35/00* (2020.01)

(58) Field of Classification Search
USPC ..... 114/259
See application file for complete search history.

(56) References Cited

U.S. PATENT DOCUMENTS

| | | | | |
|---|---|---|---|---|
| 6,843,198 | B1 * | 1/2005 | Witbeck | B63B 35/40 114/259 |
| 8,234,992 | B1 * | 8/2012 | Patterson, Jr. | B63B 27/14 114/259 |
| 11,192,613 | B2 | 12/2021 | Grall | |
| 2021/0237838 | A1 | 8/2021 | Grall | |

OTHER PUBLICATIONS

Written Opinion of the ISA dated Jun. 11, 2021, for PCT/EP2021/054686, 7 pp.

* cited by examiner

SHIP COMPRISING A SYSTEM FOR ADAPTING A REMOVABLE MODULE AND ADAPTED REMOVABLE MODULE

CROSS-REFERENCE TO RELATED APPLICATIONS

This application is the U.S. national phase of International Application No. PCT/EP2021/054686 filed Feb. 25, 2021, which designated the U.S. and claims priority to FR 2001894 filed Feb. 26, 2020, the entire contents of each of which are hereby incorporated by reference.

BACKGROUND OF THE INVENTION

Field of the Invention

The present invention generally relates to the field of shipbuilding. It more particularly relates to a ship comprising a system for adapting a removable module, as well as an adapted removable module. It allows the making of versatile ships.

Description of the Related Art

Ships adapted for the launching and recovery at sea of navigating drones are known. Document FR17 60492 can be mentioned, which describes a ship of this type.

However, these ships are specialised and have a structure adapted to this specialisation, so that they are not capable of doing efficiently and in satisfying safety conditions other missions than those for which they have been initially designed. Now, the structures and functions of both the marine or underwater drones and the missions are liable to change over time, so that a specialised ship may become obsolete. If changes in the missions and/or drones turn out to be long-lasting, it may be chosen to build a new adapted ship or to reconfigure an old ship but, in any case, building or reconfiguration, this has a cost and takes time. Moreover, this does not solve in any way the problem of non-adaptation to future new changes.

Also known are the documents FR 3 080 601 A1, WO 2010/115977 A1, WO 2012/069853 A2 and U.S. Pat. No. 5,222,454 A.

SUMMARY OF THE INVENTION

It is proposed a system for rapid and simple adaptation of a ship to different specialised functions. This adaptation is obtained by implementation of a base ship able to receive in a removable and interchangeable manner a particular module among various modules, the module being adapted to the function and providing the specialisation. In its principle, the base ship is similar to a catamaran in its rear portion because it comprises two parallel rear lateral volumes that are substantially symmetric with respect to a vertical longitudinal sagittal plane of the base ship, and a removable module is inserted and secured between the two rear lateral volumes of the base ship in order to form a functionalised ship. The base ship that is able to navigate without the module can be generally of the type catamaran with two distinct parallel hulls (immersed part of the shell) or of a different type, with a single hull, but that is sagittally open on the rear.

More precisely, it is proposed according to the invention, a functionalised ship consisted of a base ship and a removable module, the base ship comprising a system for adapting a removable module and a removable module being installed into said system for adapting the base ship to form the functionalised ship, the functionalised ship being extended longitudinally between a bow on the front and a stern on the rear and comprising at least one deck, one shell and propelling means, the shell being symmetrical with respect to a longitudinal vertical sagittal plane, the submerged lower face of the shell defining towards the front a front hull portion and defining towards the rear a rear hull portion,

- in which base ship the rear hull portion is consisted of two parts assembled together, a sagittal hull part of the base ship and a U-shaped hull part, having a U-shape in vertical view, the U-shaped hull part being in continuity with the front hull portion, the two legs of the U defining two rear lateral shell parts, the two rear lateral shell parts being closed on the rear by two lateral tables, the sagittal hull part of the base ship being arranged between the two legs of the U of the U-shaped hull part,
- in which base ship the rear part of the ship comprises, towards the top, two rear lateral deck parts topping the two rear lateral shell parts,
- in which base ship, the two rear lateral deck parts, the two rear lateral shell parts and the two lateral tables delimit two rear lateral volumes of the base ship, the module being inserted and secured between the two rear lateral volumes of the base ship to form the functionalised ship, the module having a lower face, the lower face of the module forming a sagittal hull part of the functionalised ship,
- in which functionalised ship, the module is removable and can be replaced by another module, at least one of the modules allowing the launching to water and the recovery on the ship, for the storage thereof out of water, of a marine or underwater drone, the floating or diving drone being able to dock in said module, and
- wherein, the module allowing the launching to water and the recovery on the ship of a drone is U-shaped in vertical view, said module being open towards the rear, the top and at least in part towards the bottom to delimit, when said module is inserted in the base ship, a longitudinal sagittal manoeuvring area towards the rear of the ship, which is open to the rear of the ship and submerged at least in part, in such a way that a floating drone can enter said module to dock in the manoeuvring area or exit therefrom, the floating drone docking and exiting through the rear of the ship and in such a way that the drone can be launched to water and recovered on the ship by passing through the manoeuvring area.

Other non-limiting and advantageous features of the ship according to the invention, taken individually or according to all the technically possible combinations, are the following:

- the drone is a marine drone able to float,
- the drone is an underwater drone able to dive,
- during the recovery of the underwater drone, the drone is in sub-surface/near-surface diving,
- the module does not protrude/project towards the rear of the plane defined by the two rear tables,
- as an alternative, the module allowing the launching to water and the recovery on the ship of a drone is U-shaped in vertical view, said module being open towards the rear and the top and closed towards the bottom to delimit a longitudinal sagittal manoeuvring area that is submerged when said module is inserted in the base ship, the manoeuvring area being thus closed towards the bottom, the module allowing the launching to water and the recovery on the ship of a drone is U-shaped in vertical view, said module being open towards the rear, the top and towards the bottom to delimit a longitudinal sagittal manoeuvring area that is submerged when said module is inserted in the base ship, the manoeuvring area being thus open towards the bottom, the functionalised ship can navigate, the base ship can navigate without module, the two rear lateral volumes of the ship are in continuity with a front volume of the ship, the lower face of the front volume comprising the front hull portion, the manoeuvring area of the module allowing the launching to water and the recovery on the ship of a drone has a width higher than the maximum width of the drone in such a way that the drone can move up and down in said manoeuvring area, the manoeuvring area of the module allowing the launching to water and the recovery on the ship of a drone has a length higher than the drone length in such a way that the drone can enter totally the manoeuvring area when docking, the manoeuvring area of the module allowing the launching to water and the recovery on the ship of a drone has a length equal to the drone length, the manoeuvring area of the module allowing the launching to water and the recovery on the ship of a drone has a length lower than the drone length, propelling means are arranged under the level of the two rear lateral shell parts, the ship is a manned ship, the ship has a length of at least 5 m and a width of at least 2 m, the front shell portion of the ship is single-shell, the deck, including the two rear lateral deck parts, is above the waterline, the front shell portion of the ship is consisted of two shells joined together at the front of the ship, each of the shells on the front being in the continuity of the corresponding rear lateral volume of the two rear lateral volumes of the ship, the front shell portion of the ship is consisted of two shells joined together at the front of the ship, each of the shells on the front being in the continuity of the corresponding rear lateral shell part, the two shells joined together at the front of the ship are joined above the waterline, the two shells joined together at the front of the ship are joined at the deck, the manoeuvring area of the module allowing the launching to water and the recovery on the ship of a drone is essentially closed towards the bottom except possibly an elongate sagittal opening for the passage of a keel of the drone, the manoeuvring area of the module allowing the launching to water and the recovery on the ship of a drone is essentially open towards the bottom, the functionalised ship is configured to navigate with the modules, including modules having a sagittal part of the rear shell portion essentially open towards the bottom, the functionalised ship being similar to a catamaran towards the rear, the module allowing the launching to water and the recovery on the ship of a drone, whose manoeuvring area is open towards the rear, the top and towards the bottom to delimit a longitudinal sagittal manoeuvring area that is partly submerged when said module is inserted in the base ship, the manoeuvring area being thus open towards the bottom, the drone comprises a shell and the opening towards the bottom of the sagittal part essentially open towards the bottom has a width higher than the width of the drone shell and over the height of the module, i.e. in the submerged parts and the out-of-water parts, above the submerged part, the drone has a shell and the opening towards to bottom of the sagittal part essentially open towards the bottom has a width lower than the width of the drone shell towards the bottom, in the submerged part, and a width higher than the height of the drone shell towards the top, over the height of the module, in such a way that the floating drone having docked in the module is enclosed towards the bottom, the deck comprises a superstructure on the front, the superstructure comprises a cockpit, the ship comprises guiding means, the ship comprises a motor for the propelling means, the propelling means are propellers, the propelling means are turbines, the propelling means are "outboard" engine propellers, each of the two rear lateral volumes of the ship is watertight at least on the side of water on which the ship floats, the shell is a shell made of rigid walls, the shell is a shell made of solid walls, the shell comprises at the periphery thereof a segmented inflatable tube, the module allowing the launching to water and the recovery on the ship of a drone comprises, in the manoeuvring area, a plane that is inclined from the rear and the bottom to the top and the front, the inclined plane of said module inserted in the base ship having its rear end submerged and its front end out of water, the front of the inclined plane is at at least one of the two rear lateral deck parts of the base ship, the module allowing the launching to water and the recovery on the ship of a drone is configured in such a way that the drone installed on the inclined plane has its rear end submerged, the inclined plane is perpendicular to the sagittal plane of the ship, the inclined plane is fixed, the inclined plane is tilting and forms a tilting launch ramp, the tilting inclined plane is tilting about an axis carried by the front of the inclined plane, between a tilted position of reception or launching of the drone, where the rear end of the inclined plane is submerged, and a raised position, out of water, where the rear end of the inclined plane is raised up and flush with said at least one of the two rear lateral deck part of the base ship, the module allowing the launching to water and the recovery on the ship of a drone comprises, in the manoeuvring area, a lift platform able to move between a submerged lower position of reception or launching of the drone and an upper position, out of water, substantially flush with at least one of the two rear lateral deck parts of the base ship, the module allowing the launching to water and the recovery on the ship of a drone comprises in the manoeuvring area a tilting launch ramp able to tilt between an inclined position where the rear of the ramp is submerged and the front is out of water and a horizontal position where the ramp is totally out of water, the module allowing the launching to water and the recovery on the ship of a drone is configured in such a way that, in the inclined position of the launch ramp, the drone installed on the launch ramp has its rear end submerged, the front of the tilting launch ramp is at at least one of the two rear lateral deck parts and the tilting launch ramp tilts about an axis carried by the front of the ramp, the rear end of the launch ramp comprises buoyancy means allowing said launch ramp in the inclined position to beat as a function of the water height at the buoyancy means, the launch ramp in inclined position is free to beat as a function of the water height at the buoyancy means, the beat of the launch ramp in inclined position is limited, in particular by a passive or active damping system, the launch ramp comprises at least one beat damper intended to damp the beats, the buoyancy means are inflatable tubes, the buoyancy means are a floating structure arranged in the launch ramp or forming at least part of the launch ramp, the launch ramp comprises controlled cylinders and/or chains and/or cables for the positioning in raised or inclined position according to the command, the launch ramp comprises a raised position locking device, the launch ramp comprises an inclined position locking device, the lower face of the launch ramp has a relief capable of damping the shocks caused by the waves, in particular a "breakwater" shape, the launch ramp is perpendicular to the sagittal plane of the ship in the raised and inclined positions, the two rear lateral deck parts are at the same level, the inclined plane or the platform or the ramp of the module allowing the launching to water and the recovery on the ship of a drone comprises a device for receiving a rolling trolley and the drone is stored on a rolling trolley on the ship and can be installed on the inclined plane or the platform or the ramp with its rolling trolley, said rolling trolley remaining on the inclined plane or the platform or the ramp when the drone is launched to water and the drone being recovered on said trolley on the inclined plane or the platform or the ramp, the rolling trolley is a basket that can be hoisted, the trolley comprises telescopic legs making it possible to raise or lower the drone installed on the trolley, the drone on the trolley in the manoeuvring area being lowered when launched to water and raised to be stored on the ship, the drone comprises a shell and a keel, the keel having a uniform width over its height but having no bulb at its lower end, and the inclined plane or the platform or the ramp of the module allowing the launching to water and the recovery on the ship of a drone comprises an elongated sagittal opening along which the keel can circulate longitudinally and vertically, said elongated sagittal opening having a width lower than the width of the drone shell, the keel has a width lower than the width of the drone shell with a keel, the drone comprises a shell and a keel, the lower end of the keel having a bulb of width higher than the keel width and lower than the width of the drone shell, and the inclined plane or the platform or the ramp of the module allowing the launching to water and the recovery on the ship of a drone comprises an elongated sagittal opening along which the keel and the bulb can circulate longitudinally and vertically, said elongated sagittal opening having a width lower than the width of the drone shell, the drone comprises a shell and a keel, the lower end of the keel comprising a bulb of width higher than the keel width and lower than the width of the drone shell, and the inclined plane or the platform or the ramp of the module allowing the launching to water and the recovery on the ship of a drone comprises an elongated sagittal opening along which the keel can circulate longitudinally but through which the bulb cannot circulate vertically, and the drone is stored on the ship with the inclined plane or the platform or the ramp that are separated from the module, said elongated sagittal opening having a width lower than the bulb width and than the width of the drone shell, the module allowing the launching to water and the recovery on the ship of a drone comprises, on the bottom and towards the rear of the manoeuvring area, an elongated sagittal opening whose width allows the passage of a keel end bulb of a drone comprising a keel whose lower end comprises a bulb of width higher than the keel width, the drone has a shell and a keel, and the elongated sagittal opening of the module bottom has a width lower than the width of the drone shell, the elongated sagittal opening of the module bottom allowing the launching to water and the recovery on the ship of a drone comprises two segments, a rear segment of narrow opening allowing the longitudinal circulation of the keel but not the vertical passage of the bulb and a front segment of wide opening allowing the vertical passage of the bulb, the drone comprises a shell and a keel, the lower end of the keel comprising a bulb of width higher than the keel width and lower than the width of the drone shell, and the front segment has a width lower than the width of the drone shell, the deck in the rear part of the base ship comprises a device for winching the drone, said winch device making it possible to bring the drone on one or the two rear lateral deck parts for being stored, from the manoeuvring area of the module allowing the launching to water and the recovery on the ship of a drone and, conversely, to position the drone in the manoeuvring area of the module allowing the launching to water and the recovery on the functionalised ship of a drone, the winch device is a crane for raising and lowering the drone potentially installed on its trolley, the winch device makes it possible to pull, by rolling it, the drone installed in its trolley, the winch device further makes it possible to install the module in the base ship or to remove it therefrom, the bottom of the inclined plane or platform or ramp type of the module allowing the launching to water and the recovery on the ship of a drone comprises an upper face having a shape that conforms the extent of the lower face of the drone shell, the bottom of the inclined plane or platform or ramp type of the module allowing the launching to water and the recovery on the ship of a drone comprises an upper face having a shape that conforms, at a determined distance, the extent of the lower face of the drone shell, said determined distance corresponding to the height of rolling or sliding means arranged on said upper face and allowing the rolling or sliding of the lower face of the drone shell, at least one of the modules makes it possible to totally fill the space between the two rear lateral volumes of the base ship and to bring in profile continuity the two lateral tables, the two rear lateral deck parts and the two rear lateral shell parts by closing the sagittal hull part of the module in order to totally close the space between the two rear lateral volumes of the base ship, at least one of the modules comprises means for recovering and launching to water autonomous underwater vehicles, at least one of the modules allows the launching to water and the recovery on the ship, for the storage thereof out of water, of an underwater drone, the diving drone being able to dock in the manoeuvring area of said module, the manoeuvring area being movable between a lower position in which the diving drone can dock and at least one upper position in which the lower face of said module is within the extent of the two rear lateral volumes of the ship, the lower position of the manoeuvring area allowing the docking of the diving drone is such that the lower face of said module is below the extent of the two rear lateral volumes of the ship, the module comprising means for the recovery and the launching to water of autonomous underwater vehicles is equipped with a lift basket able to move up and down in the module, the basket being able to receive, store and release an autonomous underwater vehicle, said basket being able to move down under the level of the hull of said module, the module is guided and positioned between the two rear lateral volumes of the base ship by guiding devices selected among rails, slides and by end stops, the module is removably secured to at least the two rear lateral volumes of the ship by removable locking devices, the removable locking devices are selected among the sliding shafts, in particular of the bolt type, the racks, the endless screws, the racks and gears and the spring-loaded pins, the module can float by itself when not installed in the base ship and is buoyantly stable, the floating modules can be installed on and removed from the ship floating on water without lift means, the modules being brought into the base ship while floating and moved away from the ship while floating, the ship may navigate even in the absence of module, the ship in its part non consisted of the module being watertight at least on the side of water on which the ship floats.

DESCRIPTION OF THE PREFERRED EMBODIMENTS

The following description in relation with the appended drawings, given by way of non-limiting examples, will allow a good understanding of what the invention consists of and of how it can be implemented.

In FIGS. 1 to 11, the drone is a marine drone 16 intended to float at the surface of water.

Figure 1:
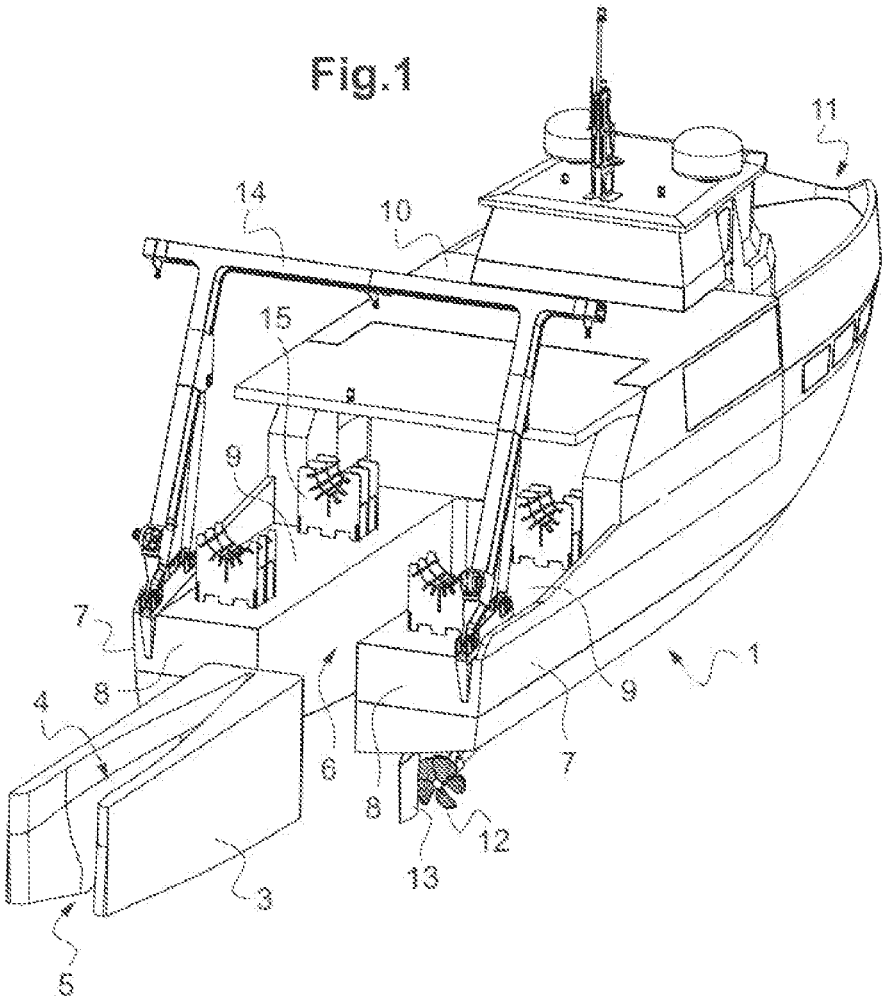
FIG. 1 is a rear perspective side view of a base ship, that is to say a ship able to be functionalised, and thus without removable module.

In FIG. 1, the ship 1 is shown without functionalisation module, the module having been moved out from the rear part of the ship shell. This ship 1 without module is a base ship that can navigate. When this base ship will have received in its rear part a module and when the latter will have been installed and secured in this rear part, the ship will then be a functionalised ship, the module providing one or several determined functions. In FIG. 1, the module is a module 3 allowing the launching to water and the recovery on the ship of a drone.

The base ship is extended longitudinally between the front/bow 11 and the rear/stern. The base ship comprises a shell with a continuous front part forming a continuous hull portion. The rear part of the shell comprises a sagittal rear shell opening 6, which forms two rear lateral shell parts 7 delimiting two rear lateral volumes of the ship. The base ship thus comprises on the rear a U-shaped hull part. On the rear, the base ship is similar to a catamaran and the two rear lateral shell parts 7 join the front shell part. The rear part of the shell and the hull thereof has thus a U-shape when the base ship is observed vertically.

The base ship comprises two rear lateral deck parts 9 topping the two rear lateral shell parts. The two rear lateral volumes of the ship are delimited by the two rear lateral shell parts 7, two tables 8 and the two rear lateral deck parts 9, and these two rear lateral volumes are connected to the volume defined by the continuous front part of the shell.

A hoisting gantry crane 14 of a winch device and drone supports 15 are arranged on the two rear lateral deck parts 9. A superstructure 10 is arranged on the ship shell with, towards the front, a cockpit.

The base ship 1 comprises propelling means 12 and guiding means 13 which are here located below the two rear lateral shell parts 7.

The base ship is thus a hybrid ship between a single-shell on the front and a catamaran on the rear. The two rear lateral shell parts 7 are generally symmetrical to each other, just as the base ship with respect to a sagittal/antero-posterior plane. The base ship 1 of the first example of ship of FIGS. 1 to 5 has a typical length of 25 m and a typical width of 6 m. The base ship of the invention can however have a length between 6 m and 150 m and a width between 0.8 m and 30 m according to the model. Moreover, it will be seen that the second example of ship 2 of FIGS. 6 to 11 is smaller than the first example of ship.

The sagittal rear shell opening 6 is intended to receive a module 3 that will be removably secured thereto.

The installation of the module in the base ship can be made, according to the configurations, by the top or by the rear of the base ship. For that purpose, hoisting means from the base ship may be used, in particular the hoisting gantry crane, or external means. For the installation (and conversely for the removal), floating modules may be provided, with a docking by the rear and entry of the floating module into the base ship that is on water.

Preferably, the sagittal hull part of the base ship is open towards the bottom, the top and the rear, and the base ship is thus similar to a catamaran on the rear. In other embodiments, the sagittal hull part of the base ship is open towards the top and the rear and closed at least in part towards the bottom, underwater.

In the functionalised ship, that is to say comprising the module, the rear structure of said ship depends essentially on the structure of the module that has been inserted between the two rear lateral volumes of the base ship.

If a module for the recovery and launching to water of a drone is implemented, a functionalised ship is obtained, which is able to execute such operations and whose rear structure of the sagittal hull part depends on functional and structural means of the module with, for example, an inclined plane and an opening towards the rear and the top.

Generally, a module for the recovery and launching to water of a drone will be open towards the rear.

For example, with a filling module, a functionalised ship that is totally closed on the rear, bottom and top in its sagittal part, and similar to a single-shell, can be obtained. The module 3 allowing the launching to water and the recovery on the ship of a drone has a U-shape 5, open towards the rear and over its height, hence forming a manoeuvring area 4 having the shape of a well (open on the rear side and liable to be inclined on the front side), at least partially submerged towards the bottom, so that a floating drone can dock inside said module 3.

The bottom of the manoeuvring area may be fixed as in the case of a fixed inclined plane or movable as in the case of a tilting launch ramp or a lift platform. However, two parts may be provided at the bottom of the manoeuvring area, a fixed part closing at least in part towards the bottom of the manoeuvring area and, above, a movable part corresponding to the tilting launch ramp or to the lift platform. Preferably, the fixed part will be within the extent of the two rear lateral volumes of the ship and the floating drone will dock and exit through the rear.

The lower part of the manoeuvring area 4 may be closed or not towards the bottom. The lower part of the manoeuvring area 4, in the case where it is closed towards the bottom, may be partly inclined from the bottom and rear towards the front and top. The lower part of the manoeuvring area 4, in the case where it closed towards the bottom, may be substantially horizontal. In a lower part of the closed manoeuvring area 4, an elongated sagittal opening along which the keel of a drone may circulate at least longitudinally is provided.

In a preferred embodiment, the module allowing the launching to water and the recovery on the ship of a drone comprises in its manoeuvring area an articulated launch ramp that is able to tilt to be inclined. The articulation of the launch ramp is located towards the front end of the launch ramp. Therefore, the rear end of the launch ramp may be lowered down and brought underwater to be submerged, under the waterline of the ship when the launch ramp is inclined. The tilted launch ramp, just as the inclined plane, comprises a submerged rear part.

The tilting/inclination of the launch ramp can be ensured by a swivel joint, the axis of the joint being elongated transversally (perpendicular to the sagittal plane of the ship), along the width of the launch ramp that has therefore an angular displacement possible in a single plane, the sagittal plane. However, it is provided a tilting of more than one degree of freedom with angular displacements possible in two perpendicular planes, a sagittal one and, in addition, a transverse one. In this latter case, this can allow for pitch compensation and also roll/heel compensation, in particular when the launch ramp is provided with a reserve buoyancy in order to be half-immersed when in lower position, with or without the drone in the manoeuvring area and installed on the launch ramp. This compensation may avoid that the surface of the inclined launch ramp goes too far from the horizontal in the transverse direction, the ramp being inclined in the longitudinal direction. With this buoyancy of the rear end of the launch ramp, the compensation is passive but, as an alternative or as a supplement, an active compensation by effectors controlled as a function of measurements taken by pitch, or even also roll, sensors, is provided. A system for passive or active damping of the rotation motions about the swivel or ball joint or any other suitable joint type may be implemented.

Preferably, the launch ramp, thanks to its buoyancy means, can beat freely in the inclined position, as a function of the waves, a beat damping device being however implemented. In such conditions, the launch ramp thus passively adapts to the sea surface height with respect to the ship. Stops may be provided to limit the beat stroke in the inclined position of the launch ramp.

It may also be provided, on the lower face of the launch ramp, a shape and/or a structure and/or a material that damps the wave impact on the inclined launch ramp. The material may be a porous double-skin absorbing the wave impact.

Figure 2:
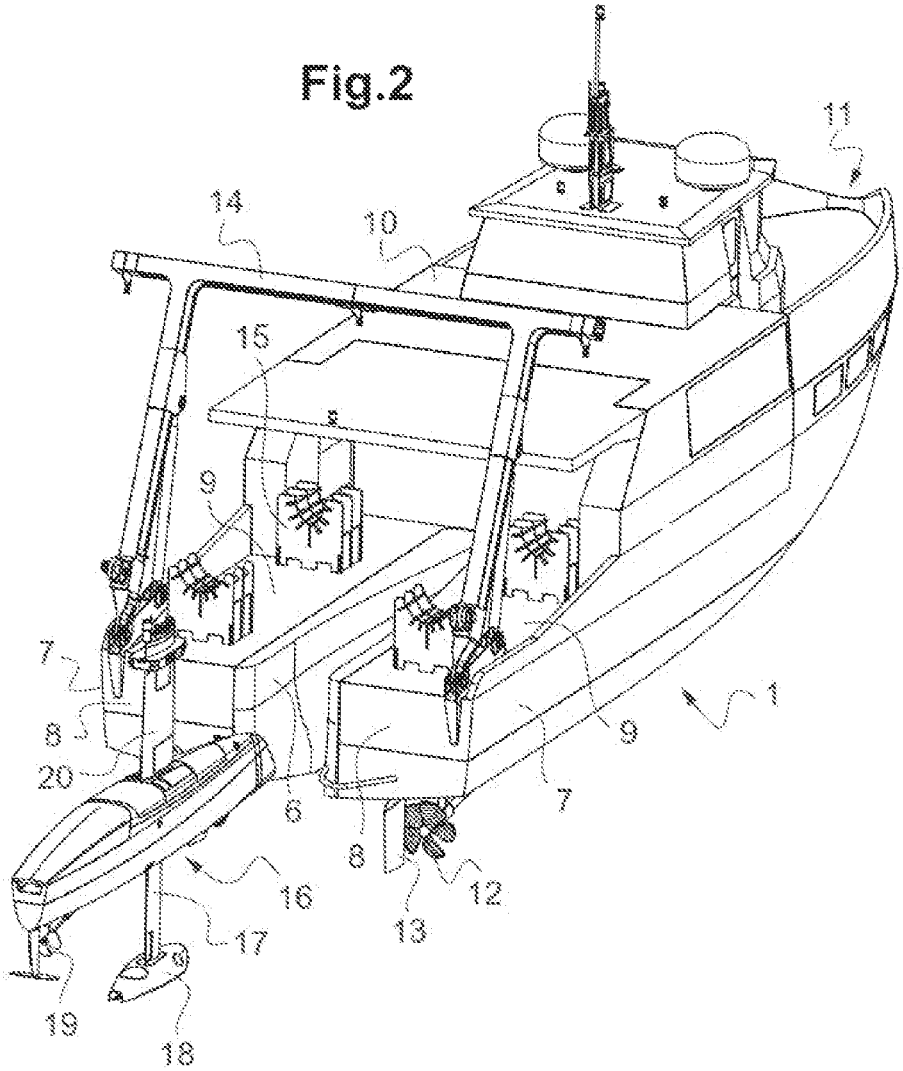
FIG. 2 is a rear perspective side view of a base ship in which is inserted the module allowing the launching to water and the recovery on the ship of a drone, a floating drone approaching to dock in the module, a functionalised ship being thus achieved.

In FIG. 2, the module 3 has been inserted between the two rear lateral shell parts 7 and a floating drone 16 is ready to enter and dock into the module 3. The drone comprises a keel 17 ending towards the bottom by a bulb 18. The drone comprises a propelling means, here provided with a propeller 19. The drone 16 comprises a wheelhouse 20 erected on its shell.

When launching/putting the drone to water, it is preferable that au least the rear end of the drone that comprises propelling means is submerged in such a way that the drone can leave the manoeuvring area by activating its propelling means. In the case of a tilted launch ramp or an inclined plane, the gravity may be sufficient so that the drone moves down passively to water. The manoeuvring area may finally be configured in such a way that the marine drone lowered down to the bottom of the manoeuvring area is floating and free.

The inclined plane and the launch ramp may comprise rolls and/or rollers and/or bearings and/or slides and/or sliding bands facilitating the lowering and the raising of the drone. A guiding system may be provided between the drone and the manoeuvring area.

Figure 3:
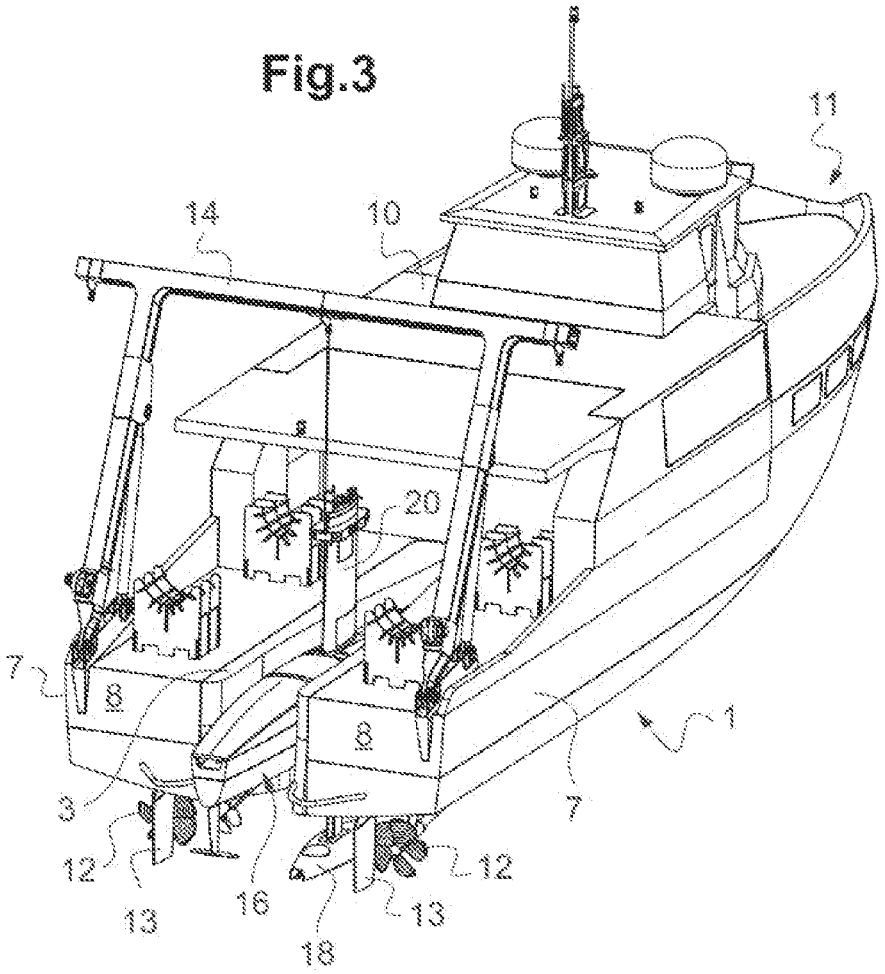
FIG. 3 shows the ship of FIG. 2, the floating drone having docked in the module and a sling from a winch on a gantry crane having been hooked to the drone.
Figure 4:
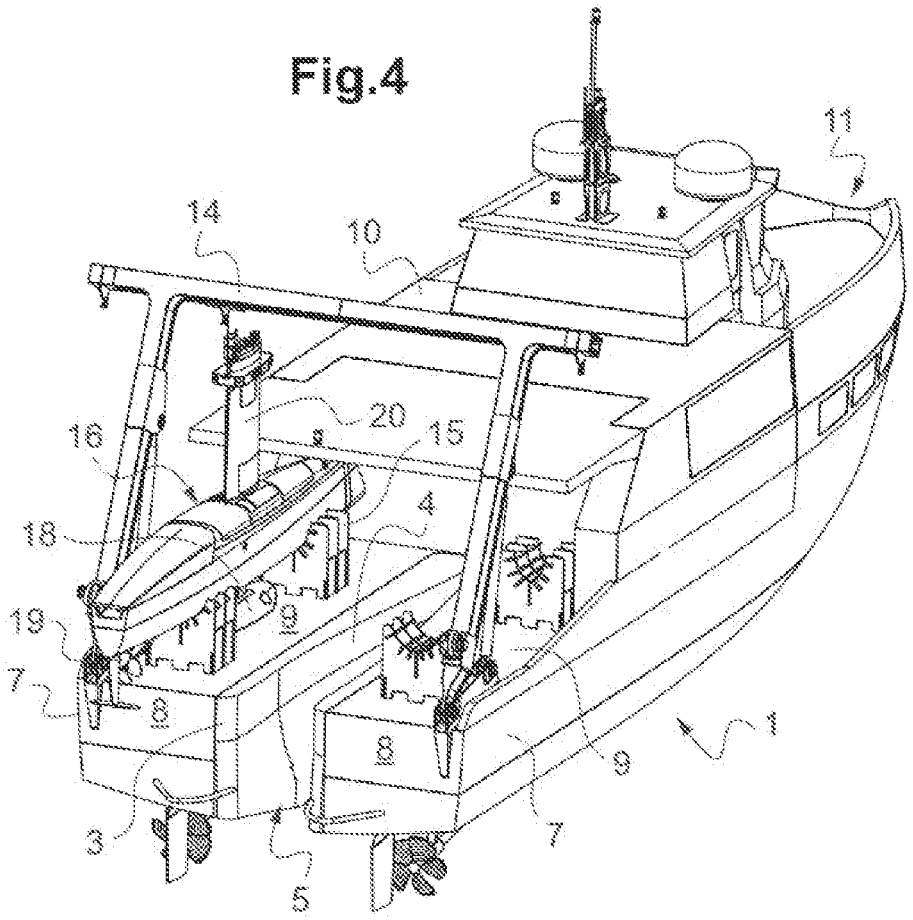
FIG. 4 shows the ship of FIG. 2, the drone having been installed on one of the two rear lateral deck parts after having been hoisted out of the module by the winch on a gantry crane.

In FIG. 3, the floating drone 16 has docked in the module 3 and a sling of the winch device comprising the gantry crane 14 has been hooked to the drone in such a way that the latter can be hoisted to the deck then placed on the drone supports 15 of one of the two rear lateral deck parts 9 of the base ship, as shown in FIG. 4.

Figure 5:
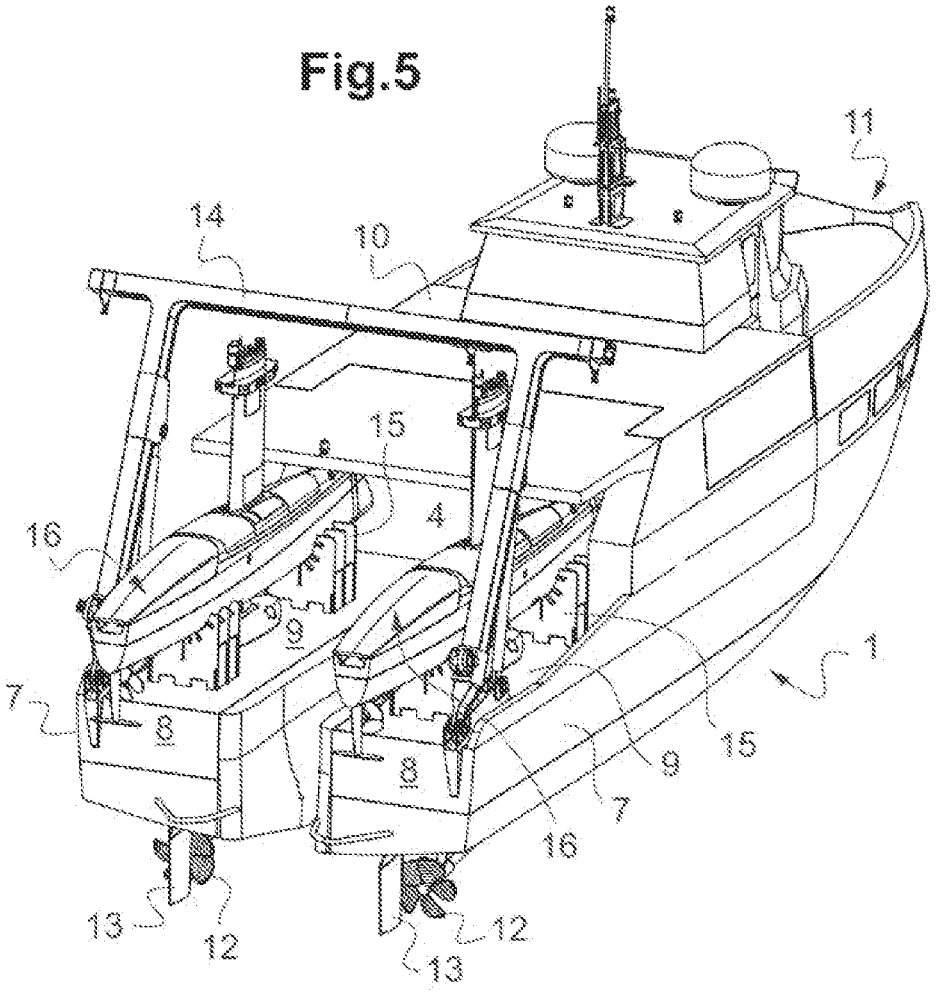
FIG. 5 shows the ship of FIG. 2, two drones having been installed on the two rear lateral deck parts.

It is understood, due to the fact that there are two rear lateral deck parts 9, both comprising supports 15, that it is possible to store two drones 16 on the functionalised ship 1, as shown in FIG. 5.

Figure 6:
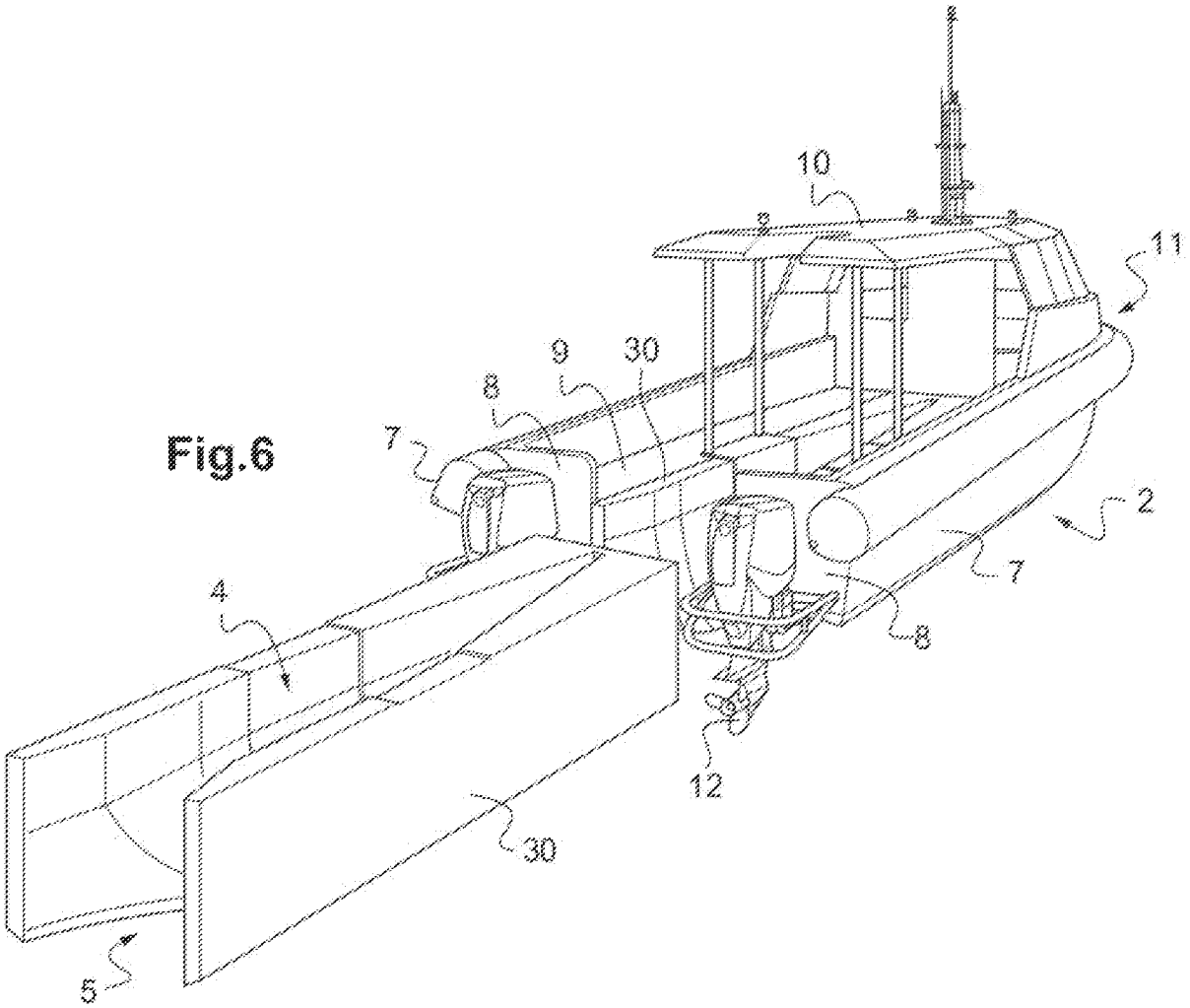
FIG. 6 is a rear perspective side view of another base ship, smaller than that of FIGS. 1 to 5, with two positions of the module allowing the launching to water and the recovery on the ship of a drone, a position of the module outside the ship and a position of the module inserted in the base ship.

In FIG. 6, a functionalised ship 2 of another type is shown. It comprises outboard engines. A module 30 allowing the launching to water and the recovery on the functionalised ship of a drone is removably secured between the two rear lateral shell parts 7. The module 30 located outside the ship 2 has also been shown.

Figure 7:
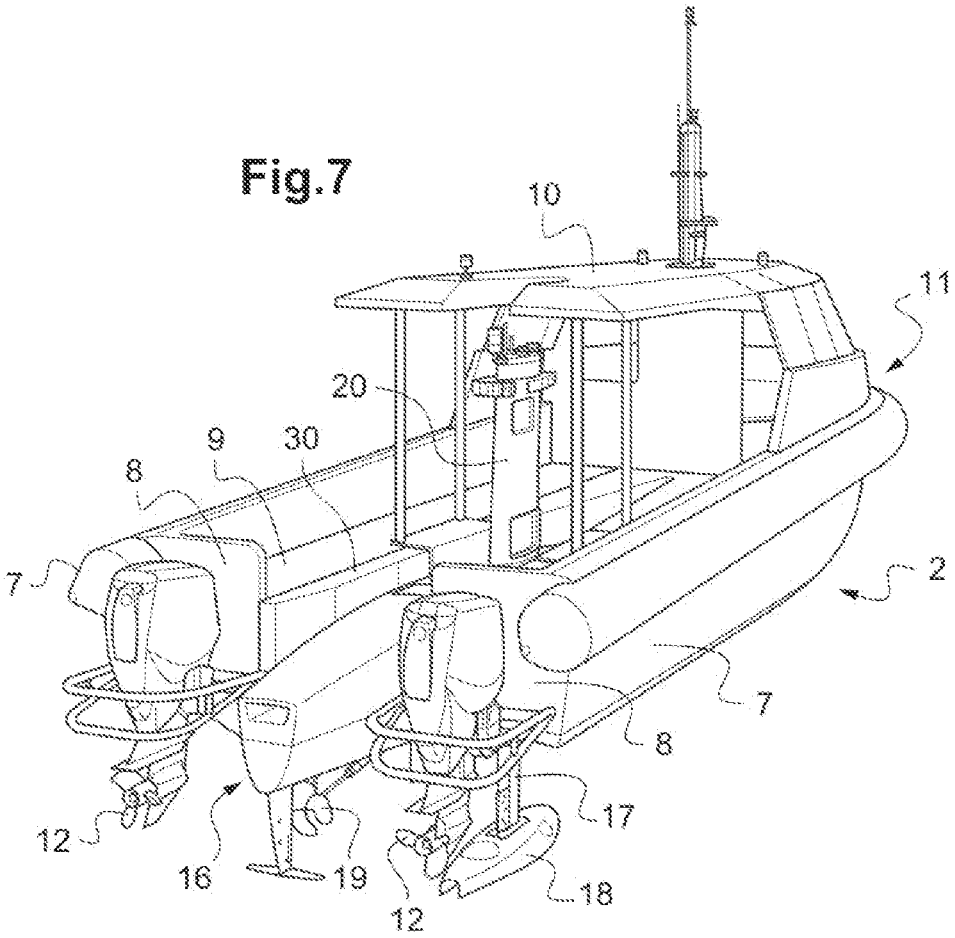
FIG. 7 shows the ship of FIG. 6, the floating drone having just docked in the module.
Figure 8:
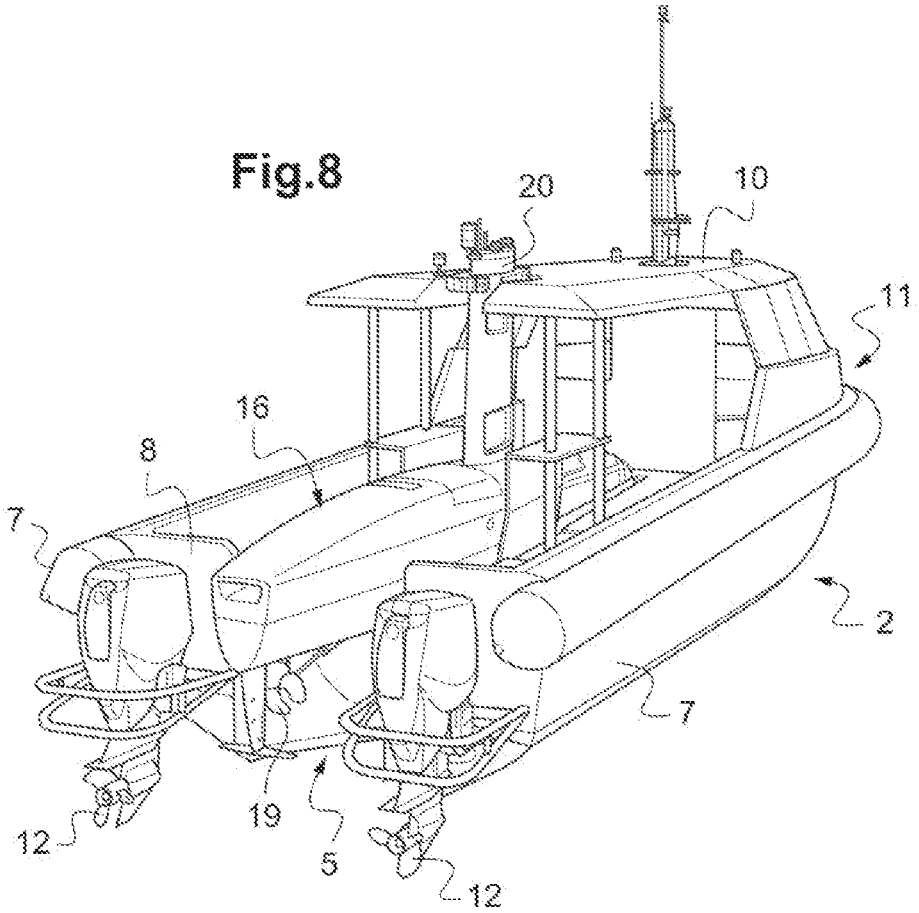
FIG. 8 shows the ship of FIG. 6, the drone having been lifted up by the lift platform comprised by the module allowing the launching to water and the recovery on the functionalised ship of a drone.
Figure 9:
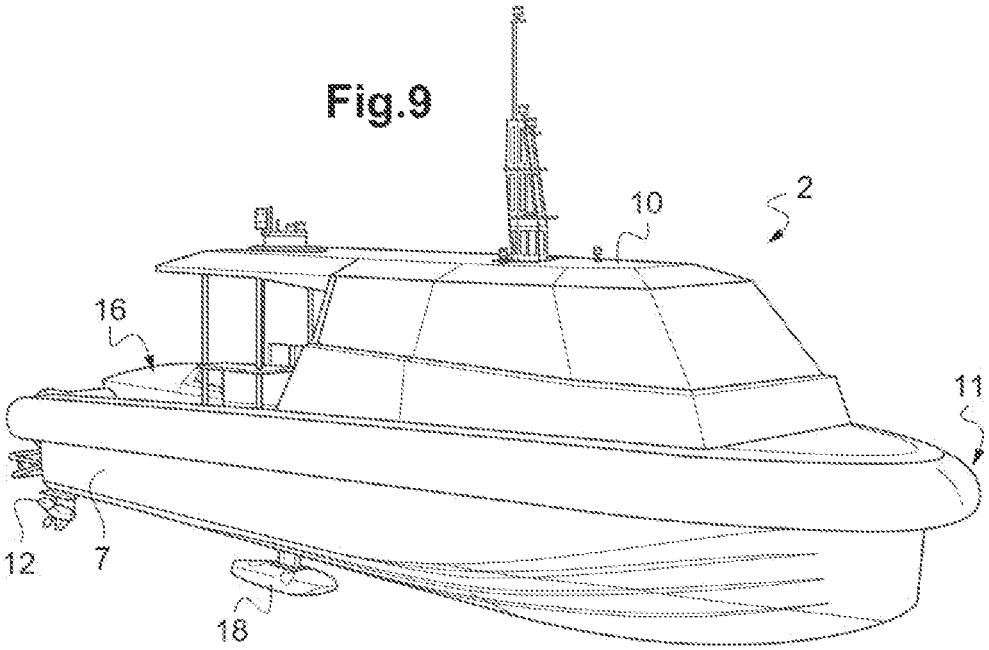
FIG. 9 is a front perspective side view of the functionalised ship of FIG. 8, the appendices under the drone, except the bulb at the lower end of the drone keel, being raised above the lower plane of the functionalised ship shell.

As hereinabove, the floating drone 16 can enter the module 30 and dock therein. That what is shown in FIG. 7. However, the module 30 comprises in this example a means for lifting the drone 16 and the latter is not hoisted and deposited on the ship deck, the drone remaining in the module 30, only the bulb 18 and the lower part of the keel of the drone 16 protruding bellow the shell of the ship 2, as can be seen in FIGS. 8 and 9.

Figure 10:
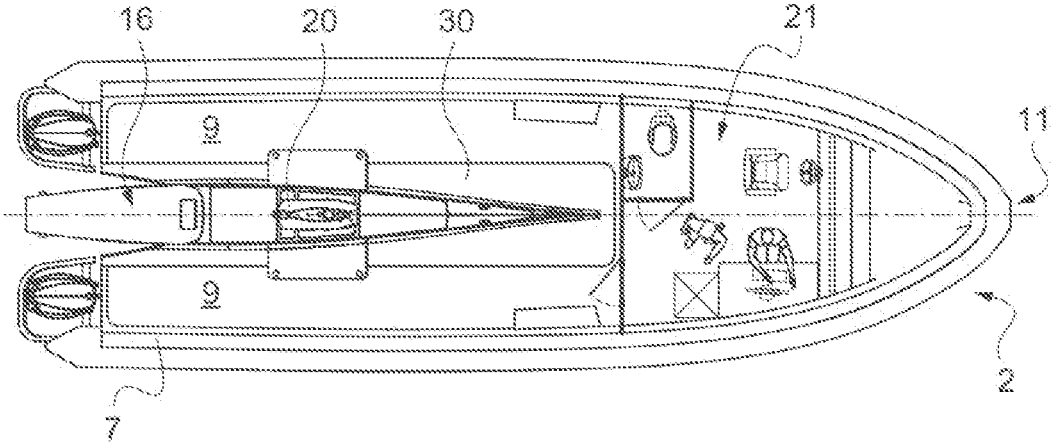
FIG. 10 is a top view, of a cross-section along a horizontal plane carried by the two rear lateral deck parts of the functionalised ship of FIG. 6, the floating drone having just docked in the module.
Figure 11:
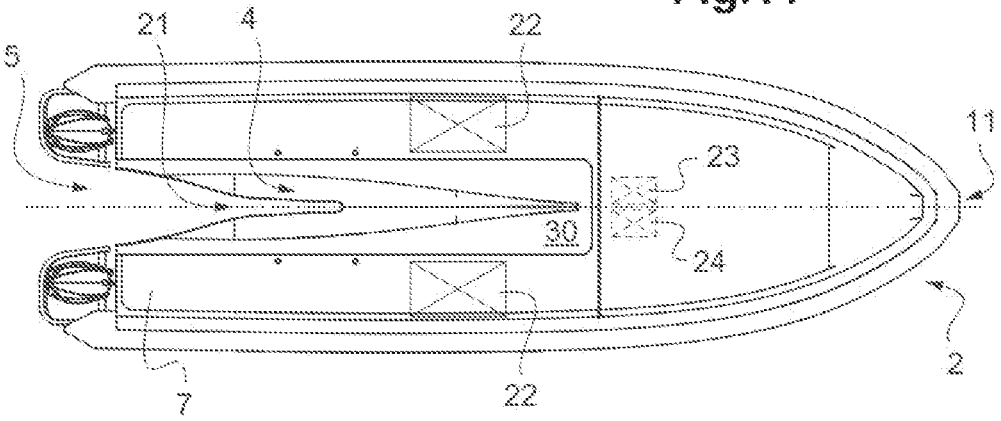
FIG. 11 is a top view, of a cross-section along a horizontal plane passing underneath the two rear lateral deck parts of the functionalised ship of FIG. 6, the drone being absent.

In FIGS. 10 and 11, the arrangements of the cockpit 21 and the gas-oil tanks 22 can be seen, as well as that for drinking water 23 and that for liquid wastes 24 in the ship 2.

It is to be noted that the bottom of the manoeuvring area 4 of the module 30 comprises a closed part with an elongated sagittal opening 21 along which the keel of the drone can circulate longitudinally. It is understood that such an elongated sagittal opening is made in the bottom of the module 3 so that a drone with a keel 17 can be received. An area of widening of the opening 21 is provided for the vertical passage of the bulb 18 of the drone when the latter is hoisted (or lowered down) on the deck in the case of ship 1 or, then, the bottom of the manoeuvring area 4 is not closed.

It is understood that modules of different functions can be installed in the base ship.

The invention claimed is:

1. A functionalized ship extending longitudinally between a bow on the front and a stern on the rear, the functionalized ship comprising:

a removable module;

a base ship comprising an adaption system configured to adapt the removable module, the removable module installed into said adaption system to adapt the base ship to form the functionalized ship;

at least one deck;

one shell being symmetrical with respect to a longitudinal vertical sagittal plane, a lower face of the shell configured to be submerged, the lower face defining a front hull portion towards the front of the functionalized ship and defining a rear hull portion toward the rear of the functionalized ship, the rear hull portion comprising two parts assembled together in the base ship, the rear hull portion including a sagittal hull part of the base ship, and a U-shaped hull part, having a U-shape in vertical view, the U-shaped hull part being in continuity with the front hull portion, the two legs of the U defining two rear lateral shell parts, the two rear lateral shell parts being closed on the rear by two lateral tables, the sagittal hull part of the base ship being disposed between the two legs of the U of the U-shaped hull part;

a propeller; and two rear lateral deck parts in the rear part of the base ship towards a top of the base ship, the two rear lateral deck parts topping the two rear lateral shell parts, the two rear lateral deck parts, the two rear lateral shell parts, and the two lateral tables delimiting two rear lateral volumes of the base ship, wherein the removable module is configured to be inserted and secured between the two rear lateral volumes of the base ship to form the functionalized ship, the removable module having a lower face forming a sagittal hull part of the functionalized ship, the removable module is removable and configured to be replaced by another module, at least one of the modules allowing launching to water and recovery on the functionalized ship, for storage thereof out of water, of a marine or underwater drone configured to dock in said removable module, and wherein the removable module is U-shaped in vertical view, said removable module being open towards the rear, the top and at least in part towards the bottom to delimit, when said removable module is inserted the base ship, a longitudinal sagittal maneuvering area towards the rear of the functionalized ship and that is open to the rear of the functionalized ship and configured to be submerged at least in part, such that the marine or underwater drone is able to enter into said removable module to dock in the longitudinal sagittal maneuvering area or exit therefrom, the marine or underwater drone docking and exiting through the rear of the functionalized ship such that the marine or underwater drone is able to be launched to water and recovered on the marine or underwater ship by passing through the longitudinal sagittal maneuvering area, wherein the removable module is selected from one of:

(i) a first removable module comprising, in the longitudinal sagittal maneuvering area, a plane that is inclined from the rear and the bottom to the top and the front, the inclined plane of said removable module inserted in the base ship having its rear end submerged and its front end out of water when the removable module is in the water, (ii) a second removable module comprising, in the longitudinal sagittal maneuvering area, a lift platform configured to move between a submerged lower position of reception or launching of the marine or underwater drone and an upper position, out of water, substantially flush with at least one of the two rear lateral deck parts of the base ship when the removable module is in the water, and (iii) a third removable module comprising, in the longitudinal sagittal maneuvering area, a tilting launch ramp configured to tilt between an inclined position where the rear of the ramp is submerged and the front is out of water and a horizontal position where the ramp is totally out of water when the removable module is in the water.

2. The ship according to claim 1, wherein, in a case in which the removable module is the first removable module, the inclined plane of the removable module comprises a device configured to receive a rolling trolley, the marine or underwater drone being stored on the rolling trolley on the functionalized ship and configured to be installed on the inclined plane with the rolling trolley, said rolling trolley remaining on the inclined plane when the marine or underwater drone is launched to water and the marine or underwater drone being recovered on said rolling trolley on the inclined plane.

3. The ship according to claim 1, wherein the removable module comprises, on the bottom and towards the rear of the longitudinal sagittal maneuvering area, an elongated sagittal opening whose width allows passage of a keel end bulb of the marine or underwater drone comprising a keel whose lower end comprises a bulb of width higher than the keel width.

4. The ship according to claim 1, wherein the deck in the rear part of the base ship comprises a winch device configured to winch the marine or underwater drone, said winch device enabling the marine or underwater drone to be brought on one or the two rear lateral deck parts to be stored, from the maneuvering area of the removable module and to position the marine or underwater drone in the maneuvering area of the removable module.

5. The ship according to claim 1, wherein the removable module is further selected from one of:

a fourth removable module configured to totally fill the space between the two rear lateral volumes of the base ship and to bring in continuity and in profile the two lateral tables, the two rear lateral deck parts and the two rear lateral parts of the shell in order to totally close the space between the two rear lateral volumes of the base ship.

6. The ship according to claim 1, wherein the removable module allows the launching to water and the recovery on the functionalized ship, for storage thereof out of water, of the marine or underwater drone, the marine or underwater diving drone being configured to dock in the longitudinal sagittal maneuvering area of said module, the longitudinal sagittal maneuvering area being movable between a lower position in which the marine or underwater drone is configured to dock and at least one upper position in which the lower face of said removable module is within the extent of the two rear lateral volumes of the base ship.

7. The ship according to claim 1, wherein the removable module is guided and positioned between the two rear lateral volumes of the base ship by guiding devices selected among rails and slides, and by end stops.

8. The ship according to claim 1, wherein the removable module is removably secured to at least the two rear lateral volumes of the base ship by removable locking devices.

9. The ship according to claim 1, wherein the base ship is configured to navigate even in the absence of removable module, the removable module being watertight at least on the side of water on which the ship floats.

10. The ship according to claim 1, wherein the removable module is configured to float by itself when not installed in the base ship, the removable module being buoyantly stable.

11. The ship according to claim 1, wherein, in the case in which the removable module is the second removable module, the lift the platform of removable module comprises a device configured to receive a rolling trolley, the marine or underwater drone being stored on the rolling trolley on the functionalized ship and configured to be installed on the lift platform with the rolling trolley, said rolling trolley remaining on the lift platform when the marine or underwater drone is launched to water and the marine or underwater drone being recovered on said rolling trolley on the lift platform.

12. The ship according to claim 1, in the case in which the removable module is the third removable module, wherein the tilting launch ramp of the removable module comprises a device configured to receive a rolling trolley, the marine or underwater drone being stored on the rolling trolley on the functionalized ship and configured to be installed on the tilting launch ramp with the rolling trolley, said rolling trolley remaining on the tilting launch ramp when the marine or underwater drone is launched to water and the marine or underwater drone being recovered on said rolling trolley on the tilting launch ramp.

* * * * *